420-445 SR
2/11/86 XF 4,569,824

United States Patent [19]
Duhl et al.

[11] Patent Number: 4,569,824
[45] Date of Patent: Feb. 11, 1986

[54] CORROSION RESISTANT NICKEL BASE SUPERALLOYS CONTAINING MANGANESE

[75] Inventors: David N. Duhl, Newington; Xuan Nguyen-Dinh, Marlborough, both of Conn.

[73] Assignee: United Technologies Corporation, Hartford, Conn.

[21] Appl. No.: 341,714

[22] Filed: Jan. 22, 1982

Related U.S. Application Data

[63] Continuation of Ser. No. 148,474, May 9, 1980, abandoned.

[51] Int. Cl.[4] ..... C22C 19/05
[52] U.S. Cl. ..... 420/448; 420/445; 420/446; 420/447; 148/404
[58] Field of Search ..... 420/445, 446, 447, 448, 420/449, 450; 148/404

[56] References Cited

U.S. PATENT DOCUMENTS

| | | | |
|---|---|---|---|
| Re. 28,681 | 1/1976 | Baldwin | 420/447 |
| 4,219,592 | 8/1980 | Anderson et al. | 75/170 |
| 4,374,084 | 2/1983 | Meetham et al. | 420/448 |

FOREIGN PATENT DOCUMENTS

| | | | |
|---|---|---|---|
| 666590 | 7/1963 | Canada | 420/448 |

*Primary Examiner*—John F. Terapane
*Assistant Examiner*—Anne Brookes
*Attorney, Agent, or Firm*—Charles E. Sohl

[57] ABSTRACT

Nickel base superalloys intended for use at low to moderate temperatures are provided with improved corrosion resistance by the addition of from 0.2 to 0.6% manganese. The manganese addition also improves the creep properties of the alloys. The manganese modified alloys are suited for use as elements in gas turbine engines for marine environments.

7 Claims, 2 Drawing Figures

CORROSION RESISTANT NICKEL BASE SUPERALLOYS CONTAINING MANGANESE

The Government has rights in this invention pursuant to Contract No. N00024-78-C-5346 awarded by the Department of the Navy.

This is a continuation of application Ser. No. 148,474 filed on May 9, 1980, now abandoned.

DESCRIPTION

Technical Field

This invention concerns the addition of small controlled amounts of manganese to nickel base superalloys for improved resistance to hot corrosion and improved creep strength. Significant reductions in hot corrosion attack are obtained in the temperature range of 1200°-1400° F.

BACKGROUND ART

In the extensive development work which has been performed on nickel base superalloys, virtually every possible element has been evaluated as an addition. It does not appear that manganese has ever been observed to have a beneficial result on superalloy properties. Manganese is often mentioned in superalloy patents but only as an impurity. Some work has been reported on the use of lanthanum and manganese mixtures for improved high temperature oxidation performance. This work is summarized in the report "Nickel-Base Superalloy Oxidation" by G. E. Wasielewski et al of General Electric, AFML-TR-69-27, Feb. 1969, pps. Lanthanum is indicated as promoting the formation of manganese-chromium spinels.

The review articles "Impurities and Trace Elements in "Nickel-Base Superalloys" by R. T. Holt et al, Int. Metal Rev., March 1976, pps 1-24, indicates that manganese is generally a detrimental trace element but that it may be added to reduce the sulfur content of nickel alloys.

DISCLOSURE OF THE INVENTION

All percentages in this application are weight percentages unless otherwise indicated. According to the present invention the hot corrosion resistance, at moderate temperatures, of nickel base superalloys is improved by the addition of from about 0.2 to about 0.6 weight percent manganese. This manganese addition is also found to significantly improve the creep resistance of the alloys.

The broad range of alloy compositions which may be improved by manganese additions is: from 12 to 20% chromium, from 3 to 14% of a refractory metal selected from the group consisting of tantalum, columbium, rhenium, tungsten, molybdenum and mixtures thereof; from 4 to 10% of a metal selected from the group consisting of aluminum, titanium and mixtures thereof; up to 20% cobalt and the usual additions of carbon, boron, zirconium and hafnium which are conventionally made to superalloys; e.g., up to 0.2% carbon, up to 0.3% boron, up to 0.1% zirconium and up to 2% hafnium. These elements are often added to alloys intended for use in polycrystalline form and are believed to strengthen the grain boundaries. Additions of from 0.2 to 0.6% manganese to alloys which fall within this composition range are found to be beneficial in improving corrosion resistance and creep properties.

These alloys may be provided in a variety of forms equiaxed polycrystalline, directionally solidified polycrystalline and as single crystals. If the alloys are provided in single crystal form, the elements carbon, boron and zirconium are preferably held at a minimum.

BEST MODE FOR CARRYING OUT THE INVENTION

Figure 1:
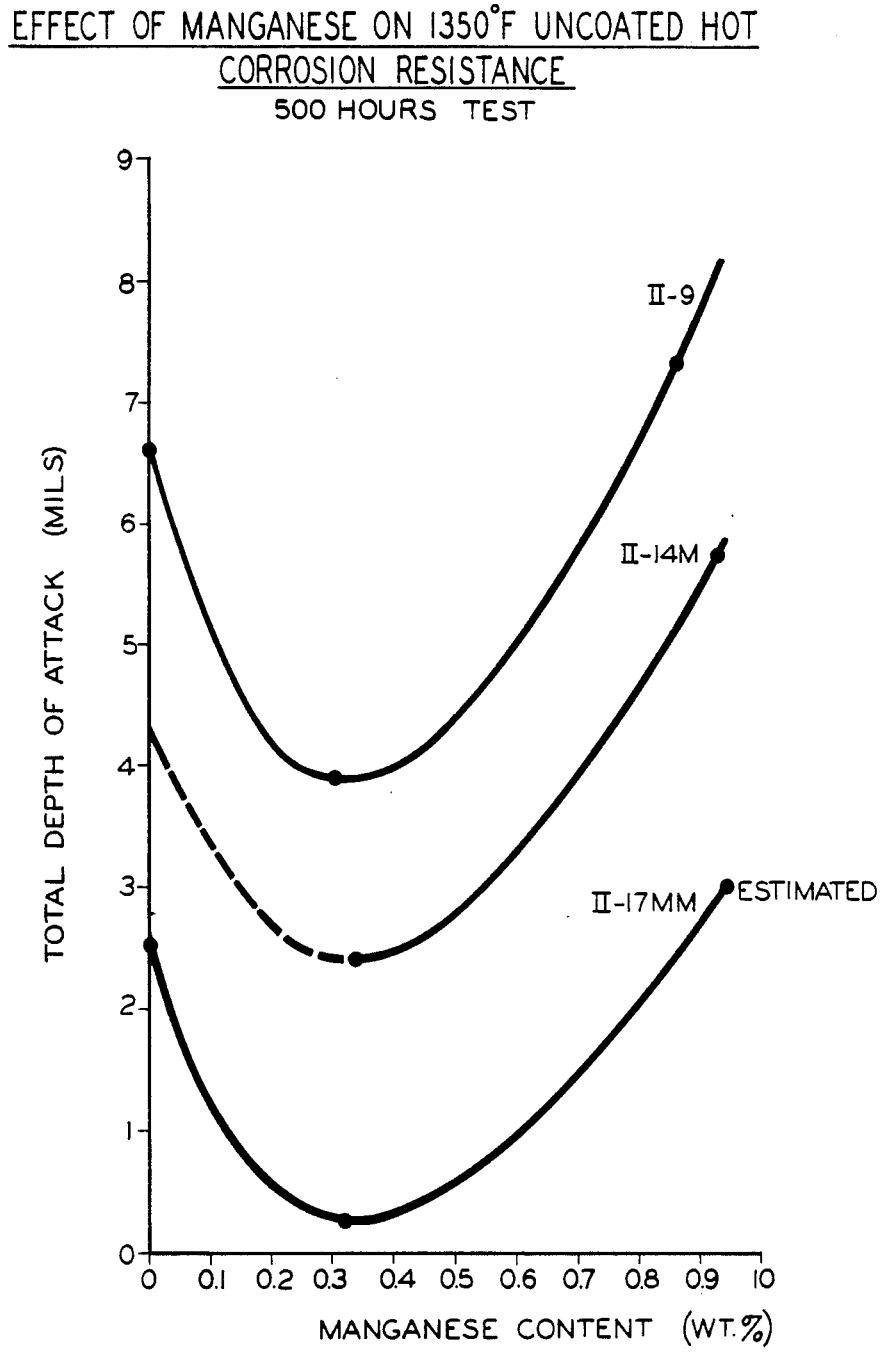
FIG. 1 shows the effect of small manganese additions on the corrosion behavior of three different nickel base superalloys at 1350° F.

This invention relates to a method for substantially improving the corrosion resistance at moderate temperatures and creep properties of nickel base superalloys. By the addition of controlled amounts of manganese, from about 0.2 to about 0.6 weight percent, substantial benefits in corrosion resistance and creep strength are obtained.

A substantial amount of materials development work has been performed in the development of alloys for use in aircraft gas turbines. The predominant direction in aircraft gas engine design has been toward higher thrust to weight ratios and higher efficiency which can best be obtained by operation at elevated temperatures with metal temperatures of 1800°-2100° F. Consequently, most gas turbine materials are optimized for service in this temperature range. Recently, development work has been undertaken directed at the commercialization of gas turbines for marine propulsion. In marine propulsion applications the predominant emphasis is on long reliable operation with minimum repair costs. This is achieved by lower operating temperatures, usually from 1200° to 1400° F., with occasional temperature exposures at up to 1600° F. under full thrust conditions. An anomalous increase in hot corrosion attack has been observed in the lower temperature ranges; e.g., at about 1350° F. In an effort to minimize this low temperature form of hot corrosion various alloying modifications were made to superalloys and it was found that controlled additions of manganese in the range of 0.2 to 0.6 weight percent were effective in reducing this form of hot corrosion attack. The mechanism by which manganese, in this low concentration, reduces the hot corrosion attack is not well understood.

The alloys in which manganese have been observed to reduce the hot corrosion attack are those which form chromia, and possibly other chrome rich oxides, as the predominant surface oxide in service. The chromia forming alloys are those which contain chromium levels in excess of about 12% and in which the chromium level substantially exceeds the aluminum level (e.g. by a factor of at least 2).

The broad range of alloy compositions to which manganese will confer a benefit is listed below:

a. 12-20% Cr;

b. 3-14% of a refractory metal selected from the group consisting of Ta, Cb, Re, W, and Mo and mixtures thereof;

c. 4-10% of a metal selected from the group consisting of Al, Ti and mixtures thereof;

d. up to 20% Co;

e. up to 0.25% C, up to 0.3% B, up to .0.1% Zr, up to 2% Hf;

f. from 0.2 to 0.6% Mn.

Within these ranges certain relationships are preferred. With alloys containing lower chromium levels (less than about 15% Cr) it is preferred that the total refractory element content exceed about 6%. It is also preferred that the ratio of titanium to aluminum be greater than 1 since this will help ensure the formation of a chromia surface oxide. If molybdenum is present it preferably constitutes less than half the total refractory content and most preferably amount to less than 2% by weight since molybdenum has been observed to aggravate hot corrosion attack in some situations. As previously noted these alloys may be fabricated as equiaxed, directionally solidified and single crystal articles. The formation of directionally solidified articles is described in U.S. Pat. No. 3,260,505 and the production of single crystal articles is described in U.S Pat. No. 3,494,709. If the alloys are produced in single crystal form the elements carbon, boron and zirconium are preferably minimized. The reason for the mimimization of these elements in single crystal applications is described in U.S. Pat. No. 4,116,723. The present invention will be better understood through reference to the following illustrative examples.

EXAMPLE 1

Eight experimental alloys were produced. They were of three different nominal compositions to which varying amounts of manganese were added. The nominal compositions are listed in Table I. Alloys of these nominal compositions were tested with no manganese added, with managanese additions of about 0.3% and with manganese additions of about 0.9%. Testing was performed by exposing samples to the products formed by the combustion of fuel oil in a ducted rig to limit dilution of exhaust gas and contaminants by ambient air. Sulfur dioxide was mixed with the combustor air and fuel to bring the sulfur content of the combustion products to the level it would be if the fuel contained 2.6% sulfur.

In addition, 20 ppm of sea salt was added to accelerate hot corrosion and to simulate the marine environment. A monitoring and control system was used to maintain the samples at a metal temperature of about 1350° F. The samples were periodically removed and evaluated for depth of corrosion attack. The results are shown in FIG. 1. FIG. 1 indicates that the addition of about 0.3% manganese results in a decrease of about 40% in hot corrosion attack, relative to a manganese free alloy, over a 500-hour test period.

Although based on limited data, FIG. 1 shows that any manganese addition up to about 0.8% will reduce hot corrosion at 1350° F. Manganese levels of 0.2–0.6% give substantial reduction in corrosion and hence are preferred.

Alloy II-9 without manganese is similar to the composition of a commercial alloy known as IN-792, supplied by the International Nickel Corporation, which is widely used in applications where hot corrosion is a problem. The addition of this small amount of manganese is seen to provide a significant improvement in corrosion attack over the baseline results of the manganese-free compositions. Similar reductions in corrosion attack are seen in the other two alloys which contain chromium levels of up to 18% Since chromium is the element which is believed to primarily control the hot corrosion behavior of superalloys it is significant that manganese is effective in reducing hot corrosion over a wide range of chromium levels thus demostrating the likely benefit of manganese additions to a wide variety of superalloys.

EXAMPLE 2

Figure 2:
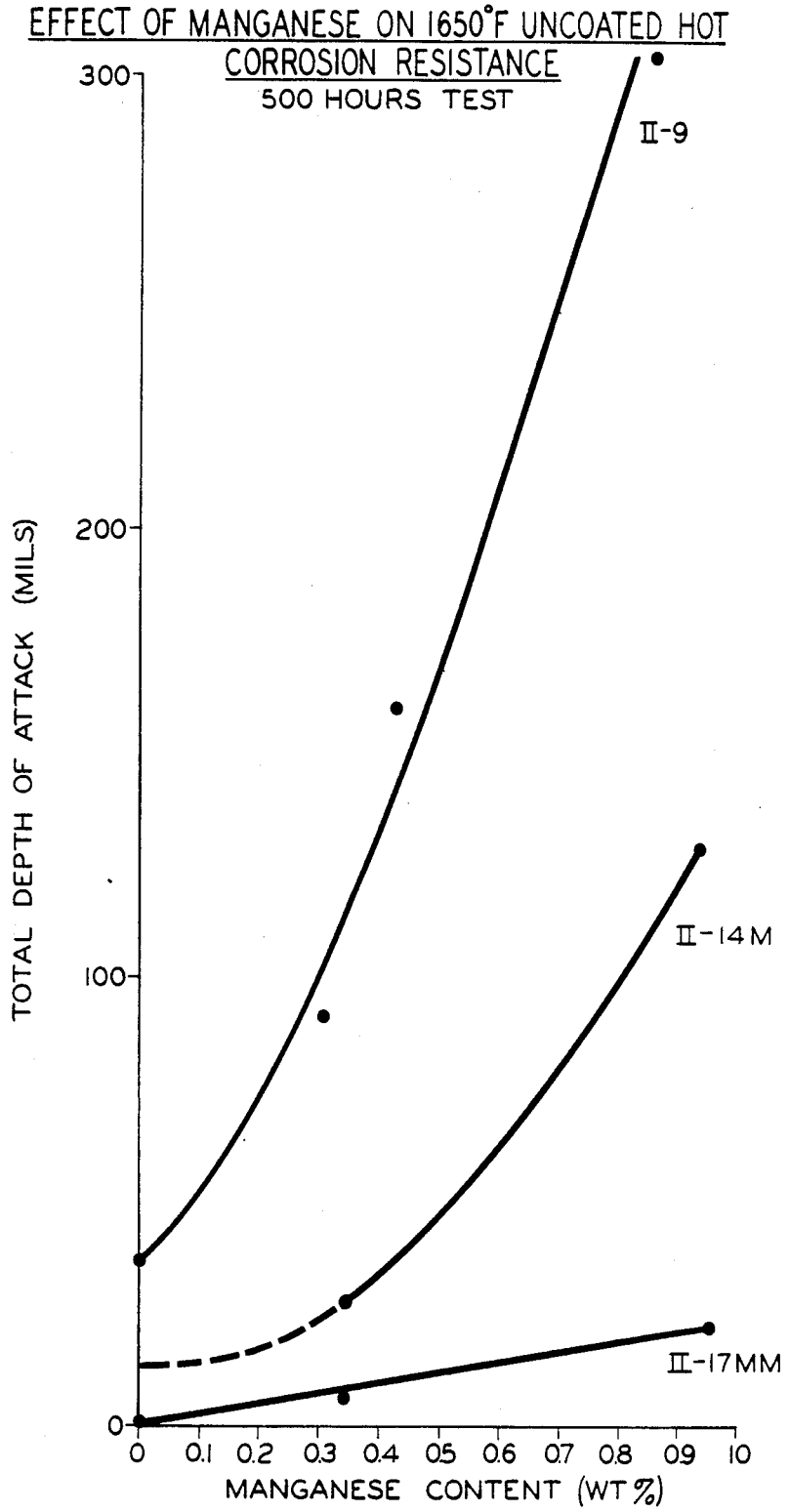
FIG. 2 shows the effect of small manganese additions on the corrosion behavior of three different nickel base superalloys at 1650° F.

FIG. 2 shows the corrosion behavior of the same alloys tested in Example 1 tested under the same conditions as those described in Example 1 except that the test temperature was increased to 1650° F. It is apparent that at this higher temperature manganese is detrimental to the hot corrosion resistance of the alloys. However, even at this higher temperature there is a slight dip in the curves which is centered at about 0.3% manganese. This example illustrates that the manganese additions to superalloys are most effective in reducing corrosions at temperatures below about 1650° F. and hence the alloys of the present invention will find their primary use in applications where temperature exposures at 1650° F. and above will be encountered infrequently.

EXAMPLE 3

Alloys having the nominal composition of alloys II-17 mm (described in Table I) were produced, in single crystal form, with manganese levels of 0; 0.5, and 1 weight percent and were creep tested at 1600° F. with an applied load of 40 ksi. The results are presented in Table II, and it is apparent that nominal additions of 0.5% manganese provide a substantial and unexpected improvement in creep properties.

In the particular application for which these alloys were developed, marine gas turbine engines, damage caused by creep occurs mainly on those rare occasions when the operating temperature approaches 1500°–1700° F. while hot corrosion damage occurs in the lower temperature range 1200°–1400° F. Consequently, the alloys of the present invention which possess improved hot corrosion resistance at 1350° F. and improved creep resistance of 1600° F. possess a unique combination of properties for specific application to marine gas turbine engines.

TABLE I

| | II-9 | II-14 m | II-17 mm |
|---|---|---|---|
| Cr | 12 | 15.5 | 18 |
| W | 4 | 4 | 3.5 |
| Ta | 6 | 4 | 3.8 |
| Al | 3.5 | 3.2 | 3.0 |
| Ti | 4.0 | 3.5 | 3.5 |
| Co | 8 | 10 | 15 |
| Ni | Bal | Bal | Bal |

TABLE II

| Mn Level | Time to 1% Creep | Time to 2% Creep |
|---|---|---|
| 0 | 20 hrs. | 78 hrs. |
| 0.5 | 88 hrs. | 229 hrs. |
| 1.0 | 9 hrs. | 40 hrs. |

We claim:

1. A marine gas turbine blade consisting essentially of:

a. 12–20% Cr;

b. 3–14% of a refractory metal selected from the group consisting of Ta, Re, Cb, W and Mo and mixtures thereof:

c. 4–10% of a material selected from the group consisting of Al, Ti, and mixtures thereof, with the Al level being less than about one-half of the Cr level;

d. 5–20% Co;

e. 0.2 to 0.6% Mn;

f. up to 0.25% C, up to 0.3% B, up to 0.1% Zr, up to 2% Hf;

g. balance nickel;

said blade forming protective chrome rich surface oxides in service and being resistant to hot corrosion in the temperature range of about 1200°-1400° F. as a result of the manganese addition.

2. A blade as in claim 1 in which the ratio of Ti to Al exceeds 1.

3. A blade as in claim 1 in which the Mo content is less than half of the total refractory metal content (Ta+Cb+Re+W+Mo).

4. A blade as in claim 1 in which the Mo content is less than 2%.

5. A blade as in claim 1 which is intended for use in single crystal form to which no intentional additions of C, B and Zr have been made.

6. A blade as in claim 1 which also displays enhanced creep resistance at 1650° F. as a result of the presence of manganese.

7. A gas turbine component comprised of:

a. 12-20% Cr;

b. 3-14% of a refractory metal selected from the group consisting of Ta, Cb, Re, W, and Mo and mixtures thereof;

c. 4-10% of a material selected from the group consisting of Al, Ti and mixtures thereof, with the Al level being less than about one-half of the Cr level;

d. 5-29% Co;

e. 0.2 to 0.6% Mn;

f. up to 0.25% C, up to 0.3% B, up to 0.1% Zr, up to 2% Hf;

g. balance nickel;

in which the ratio of Ti:Al exceeds 1, the Mo content is less than one-half of the total refractory metal content (Ta+Cb+Re+W+Mo), and the Mo content is less than 2%, said component forming protective chrome rich surface oxides in service and being resistant to hot corrosion in the temperature range of about 1200°-1400° F. as a result of the manganese addition.

* * * * *